US009464465B2

(12) United States Patent
Weinerman et al.

(10) Patent No.: US 9,464,465 B2
(45) Date of Patent: Oct. 11, 2016

(54) HANDLE ASSEMBLY

(71) Applicant: The Eastern Company, Cleveland, OH (US)

(72) Inventors: Lee S. Weinerman, Medina, OH (US); Scott Arthurs, Brunswick, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 300 days.

(21) Appl. No.: 13/831,221

(22) Filed: Mar. 14, 2013

(65) Prior Publication Data

US 2014/0265371 A1 Sep. 18, 2014

(51) Int. Cl.
*E05B 3/00* (2006.01)
*E05B 85/16* (2014.01)

(52) U.S. Cl.
CPC ..... *E05B 85/16* (2013.01); *Y10T 292/57* (2015.04)

(58) Field of Classification Search
USPC ..... 292/336.3, DIG. 30, DIG. 31
See application file for complete search history.

(56) References Cited

U.S. PATENT DOCUMENTS

| | | | | |
|---|---|---|---|---|
| 3,799,596 | A * | 3/1974 | Nozomu et al. | 292/216 |
| 4,896,906 | A | 1/1990 | Weinerman et al. | |
| 5,048,340 | A | 9/1991 | Thompson et al. | |
| 5,139,291 | A | 8/1992 | Schultz | |
| 5,431,462 | A * | 7/1995 | Lignell | 292/336.3 |
| 5,841,104 | A * | 11/1998 | Svensson | 219/125.1 |
| D418,043 | S | 12/1999 | Schlack et al. | |
| 6,174,007 | B1 | 1/2001 | Schlack et al. | |
| 6,513,353 | B1 * | 2/2003 | Weinerman et al. | 70/208 |
| 6,651,467 | B1 * | 11/2003 | Weinerman et al. | 70/208 |
| D484,025 | S | 12/2003 | Chen | |
| 6,708,537 | B1 * | 3/2004 | Eschweiler et al. | 70/208 |
| D495,237 | S | 8/2004 | Tozer | |
| D515,400 | S | 2/2006 | Tozer | |
| 7,013,689 | B2 | 3/2006 | Graham et al. | |
| 7,152,893 | B2 * | 12/2006 | Pudney | 292/336.3 |
| D541,628 | S | 5/2007 | Arthurs et | |
| 7,237,812 | B2 * | 7/2007 | Tweedy | 292/40 |
| 7,497,488 | B2 * | 3/2009 | Chen | 292/216 |
| D637,887 | S | 5/2011 | Beres et al. | |
| 8,347,667 | B2 * | 1/2013 | Bacon | 70/107 |
| 8,646,819 | B2 * | 2/2014 | Do et al. | 292/228 |

OTHER PUBLICATIONS

Eberhard Mfg. Company, a division of The Eastern Company, Catalog 116, Nov. 2011, pp. 129-131.

* cited by examiner

*Primary Examiner* — Mark Williams
(74) *Attorney, Agent, or Firm* — Ralph E. Jocke; Walker & Jocke

(57) ABSTRACT

A handle assemble is provided that includes a pivotable handle on a first side of a housing that when moved to an extended position is operative to cause a lever arm to move on a second side of the housing in order to operate a latch mechanism. To move the lever arm, the assembly includes a lock slide that in a first pivot position is operative to slide longitudinal and urge the lever arm to pivot responsive to either the handle causing a trigger to urge a first end of the lock slide to slide or an inside release member urging a second end of the lock slide to slide. However, when the lock slide is in a second pivot position, the trigger and the inside release member are not operative to engage the respective first and second ends of the lock slide.

22 Claims, 12 Drawing Sheets

HANDLE ASSEMBLY

BACKGROUND

Handle assemblies are mechanical apparatuses that are typically used to operate latches that releasably hold two elements in closed relation. Such elements for example may include a closure member and a body member. For example, latch assemblies may be used to releasably hold a closure member such as a door or hatch in a closed position relative to a body member such as a door frame or hatch frame. Handle and latch assemblies may benefit from improvements.

SUMMARY

The following is a brief summary of subject matter that is described in greater detail herein. This summary is not intended to be limiting as to the scope of the claims.

In example embodiments of one or more inventions described herein, a handle assembly may include an improved inside release mechanism. In such an example embodiment, the handle assembly may include a housing, including a first/front side and a second/rear side. Such a handle assembly is typically installed through an opening in a door, hatch, or other closure member such that the front side faces outwardly and the rear side is located inside the door.

The handle assembly may include a handle that is accessible by a user on the front side of the housing. Such a handle may be pulled by a user to cause the handle assembly to operate a latch mechanism in order to enable opening of a door, hatch or other closure member by the user. In addition the handle assembly may include a lock mechanism (e.g., a cylinder lock) that includes a key receiving receptacle on the front side of the housing. Rotating a key in one direction (e.g., clockwise) may lock the lock mechanism, such that the handle assembly is in a locked state that prevents the handle assembly and the inside release mechanism from being able to operate the latch mechanism. Also, rotating the key in an opposite direction (e.g., counter-clockwise) may place the handle assembly in an unlocked state, such that the handle assembly and the inside release are both operative to operate the latch mechanism.

Examples of latch assemblies that may be operated by the handle assemblies described herein include rotary latches. Examples of rotary latches that are operated via handle assemblies are shown in U.S. Pat. No. 4,896,906 issued Jan. 30, 1990, which is hereby incorporated herein by reference in its entirety.

In an example embodiment, the handle of the described handle assembly may include a first end that is in pivoting connection with the housing on the front side of the housing. In addition the handle may include a second end that includes a shaft. Such a shaft may extend inwardly from the second end of the handle through an aperture in the housing and into engagement with portions of the handle assembly on the rear side of the housing.

Such portions of the housing assembly on the rear side may include a trigger that is in pivoting connection with the housing on the rear side of the housing. The rear side of the housing may also include a lock slide that is operative to slide (relative to the housing) longitudinally between a retracted position and an extended position. In addition, the rear side of the housing may include one or more lever arms in pivoting connection with the housing. Such lever arms may include at least one aperture therethrough to which a linkage such as rod may be mounted which connects the at least one lever arm to a release paw of a latch mechanism.

When a user pulls the handle outwardly to an extended position, the shaft of the handle may pull on the trigger and cause the trigger to pivot. In an example embodiment, the trigger may include a projection that is positioned to urge (e.g., push) a first end of the lock slide when the trigger is pivoted via the handle. When the lock slide is pushed (via pivoting of the handle), the lock side may slide from the retracted position to the extended position, which movement urges the lever arms to pivot in a direction that moves a linkage and thereby operates the latch mechanism.

In an example embodiment, the inside release member may be mounted in sliding connection with the housing, such that the inside release member is operative to slide longitudinally between a retracted position and an extended position. The inside release may include an aperture to which a linkage may be connected which places the inside release in operative connection with another pivoting handle mounted to another portion of the closure member (such as an inside portion of a door or hatch).

When the inside release member is slid (via a linkage) from the first position to the second position, the inside release member may be operative to engage a second end of the lock slide and cause the lock side to slide from the retracted position to the extended position (as described above) and urge the at least one lever arm to pivot in a direction that moves a linkage and thereby operates the latch mechanism. Thus in this described embodiment, unlike the handle, the inside release is operative to cause the lever arms to pivot without causing the trigger to pivot.

In this described embodiment, the lock slide is also operative to pivot with respect to the housing between a first pivot position, and a second pivot position. In the first pivot position, the first and second ends of the lock slide are oriented such that both the trigger and the inside release member are operative push the lock slide so that it slides between the retracted and extended positions and cause the lever arms to pivot. However, when the lock slide is in the second pivot position, the first and second ends of the lock side are not orientated in a manner that enables the trigger and inside release member to push the lock slide between the retracted and extended positions.

Other aspects will be appreciated upon reading and understanding the attached Figures and description.

DETAILED DESCRIPTION

Figure 1:
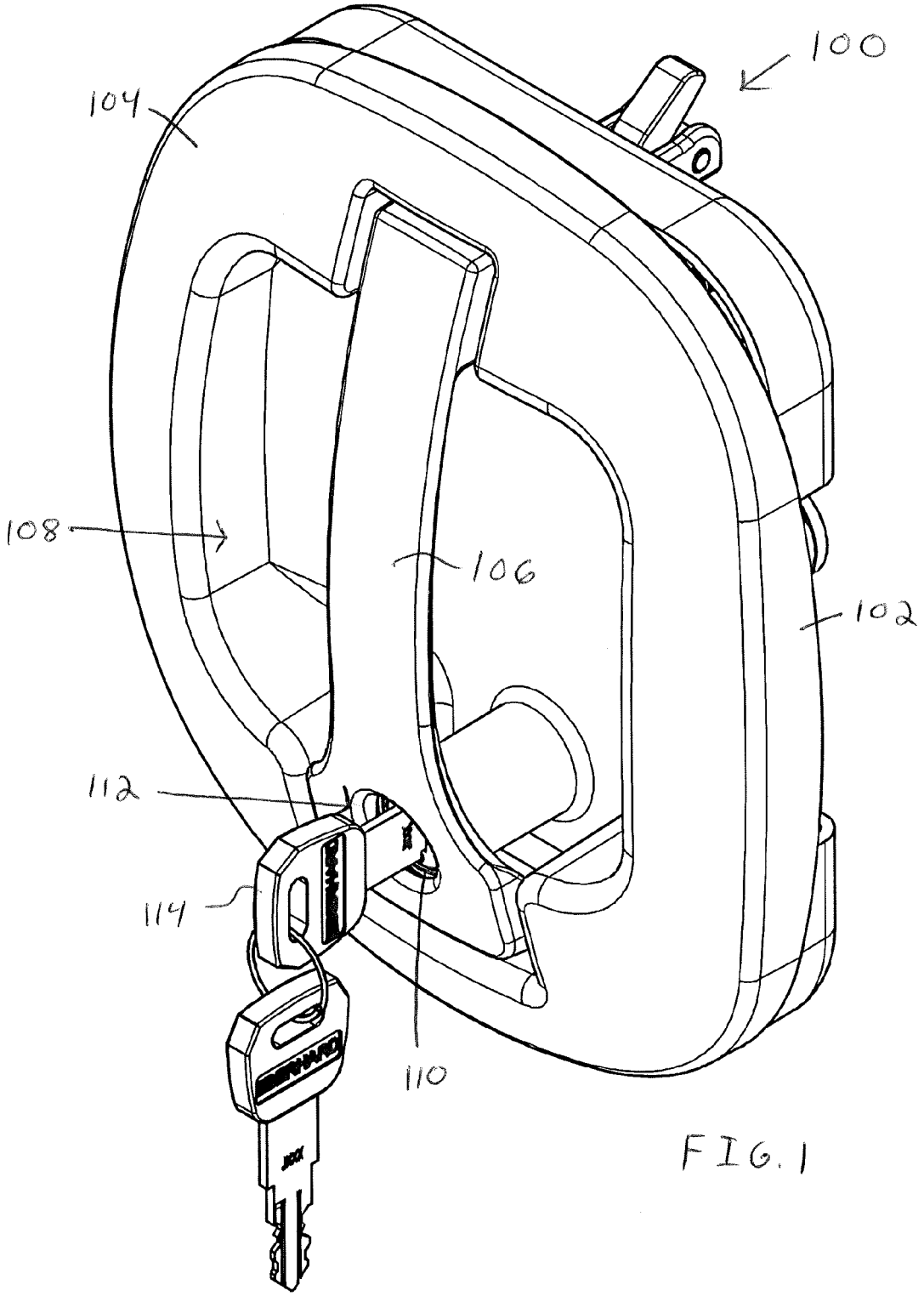
FIG. 1 is a front isometric view of an example handle assembly showing a handle in a retracted position.

Various technologies pertaining to a handle assembly for use with one or more latch mechanisms will now be described with reference to the drawings, where like reference numerals represent like elements throughout. Also, it is to be understood that functionality that is described as being carried out by certain components may be performed by multiple components. Similarly, for instance, a component may be configured to perform functionality that is described as being carried out by multiple components.

Figure 2:
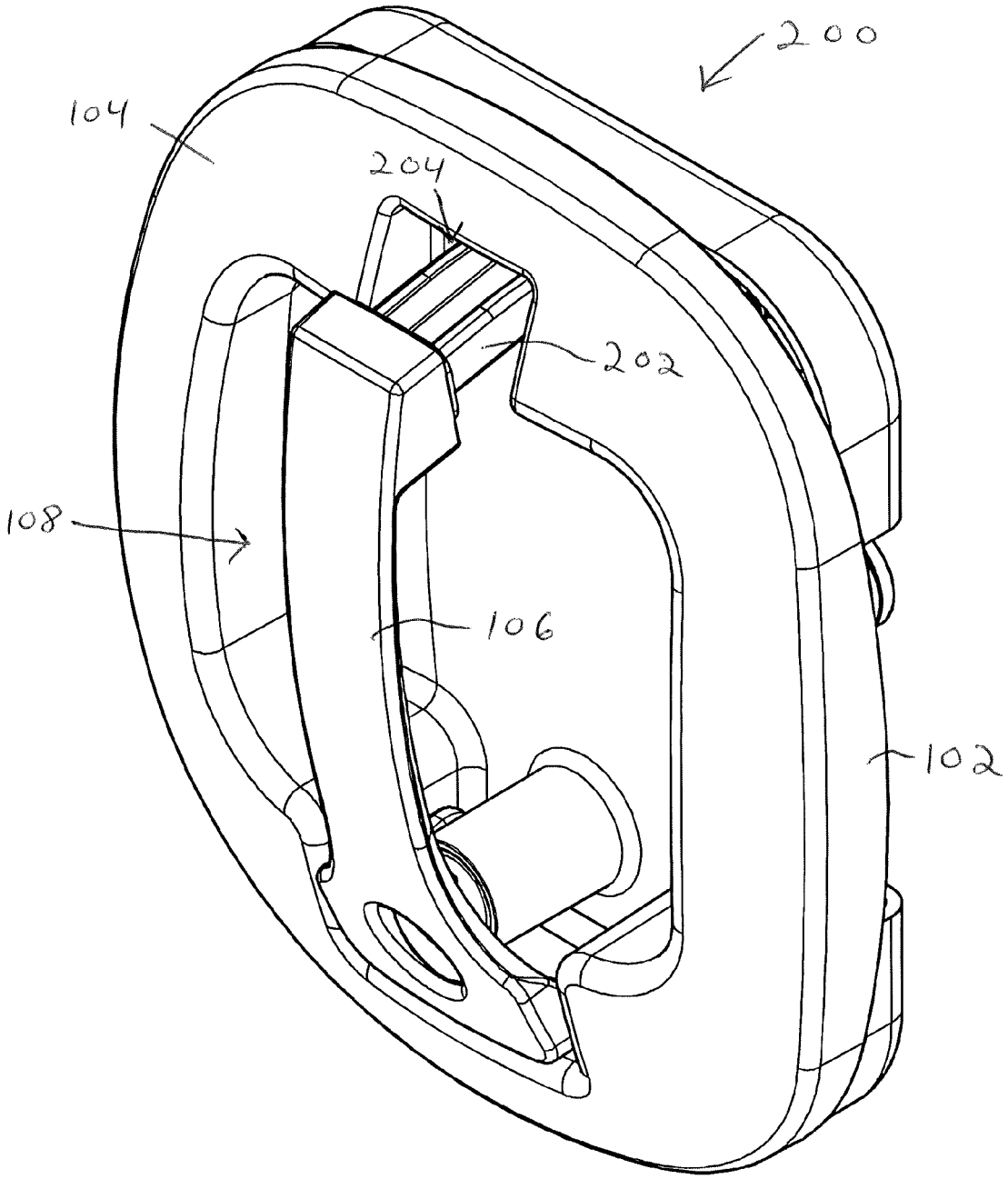
FIG. 2 is a front isometric view of an example handle assembly showing a handle in an extended position.

With reference to FIG. 1 an example 100 of a handle assembly 102 is illustrated. The handle assembly 102 includes a housing 104 which serves as a receptacle for a pivotable handle 106 on a first/front facing side 108 of the housing 104. When a user grasps and pulls on the handle, the handle is operative to pivot from the retracted position shown in FIG. 1, to an extended position shown in the example 200 in FIG. 2. Pivoting of the handle 106 in this manner is operative to cause components mounted on the rear side of the housing to operate. For example as shown in FIG. 2, the handle 106 may include a shaft 202 that extends inwardly through an aperture 204 through the housing 104, which shaft is operative to engage components of the handle assembly on the rear side of the housing assembly.

Figure 3:
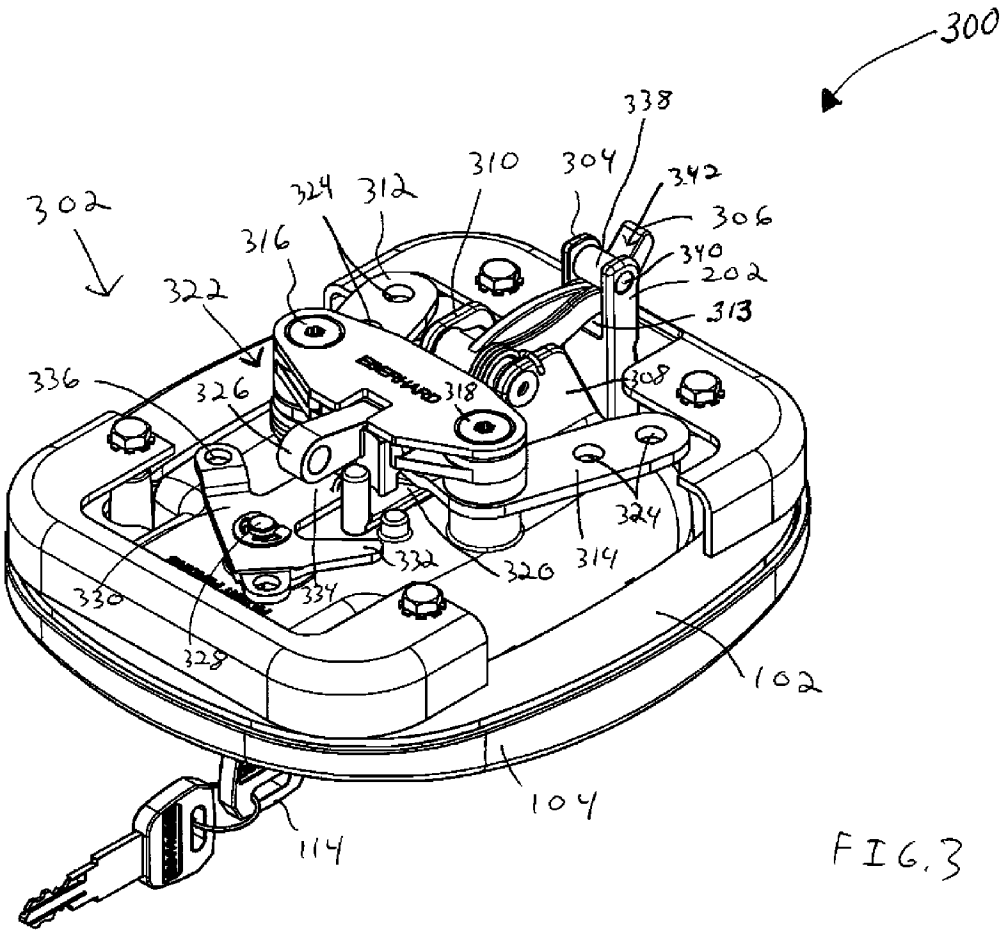
FIG. 3 is a rear isometric view of an example handle assembly when a handle is in a retracted position.

FIG. 3 illustrates a rear view 300 of the handle assembly showing the second/rear side 302 of the housing while the handle is in the retracted position. As shown in FIG. 3, an end 304 of the shaft 202 is operative to extend to the rear side 302 into engagement with a pivotable member referred to herein as a trigger 306. Such a trigger 306 may be mounted via a shaft between two parallel brackets 308, 310 that are connected to and extend outwardly from the rear side 302 of the housing 104.

In this example, the shaft 202 includes an aperture 313 bounded on one side by a rounded surface 338. Although such a rounded surface may be fixed, in this example the rounded surface includes the cylindrical surface of a roller mounted to the end 304 of the shaft 202. For example in this embodiment, the roller 338 may include portions that extend in holes 340 in opposed sides of the shaft 202 so that the roller is operative to rotate freely with respect the shaft 202. However, in an alternative embodiment the end 304 of the shaft 202 may include a pin or bolt that extends through a hole in the roller.

The trigger 306 is positioned to extend through the aperture 314 of the shaft 202. With this arrangement, the trigger is operative to pivot between a first pivot position (as shown in FIG. 3) and a second pivot position responsive to the end 304 of the shaft 202 moving toward the rear side of the housing when the handle is pulled by a user from the retracted position (shown in FIG. 1) to the extended position (shown in FIG. 2). As the trigger 306 pivots responsive to movement of the handle between the retracted and extended positions, the roller 338 is operative to roll and travel along a surface 342 of the trigger (a portion of which may include a concave surface). In this example, the roller and trigger arrangement is operative to reduce wear and friction associated with relative movements between the shaft and the trigger.

Figure 4:
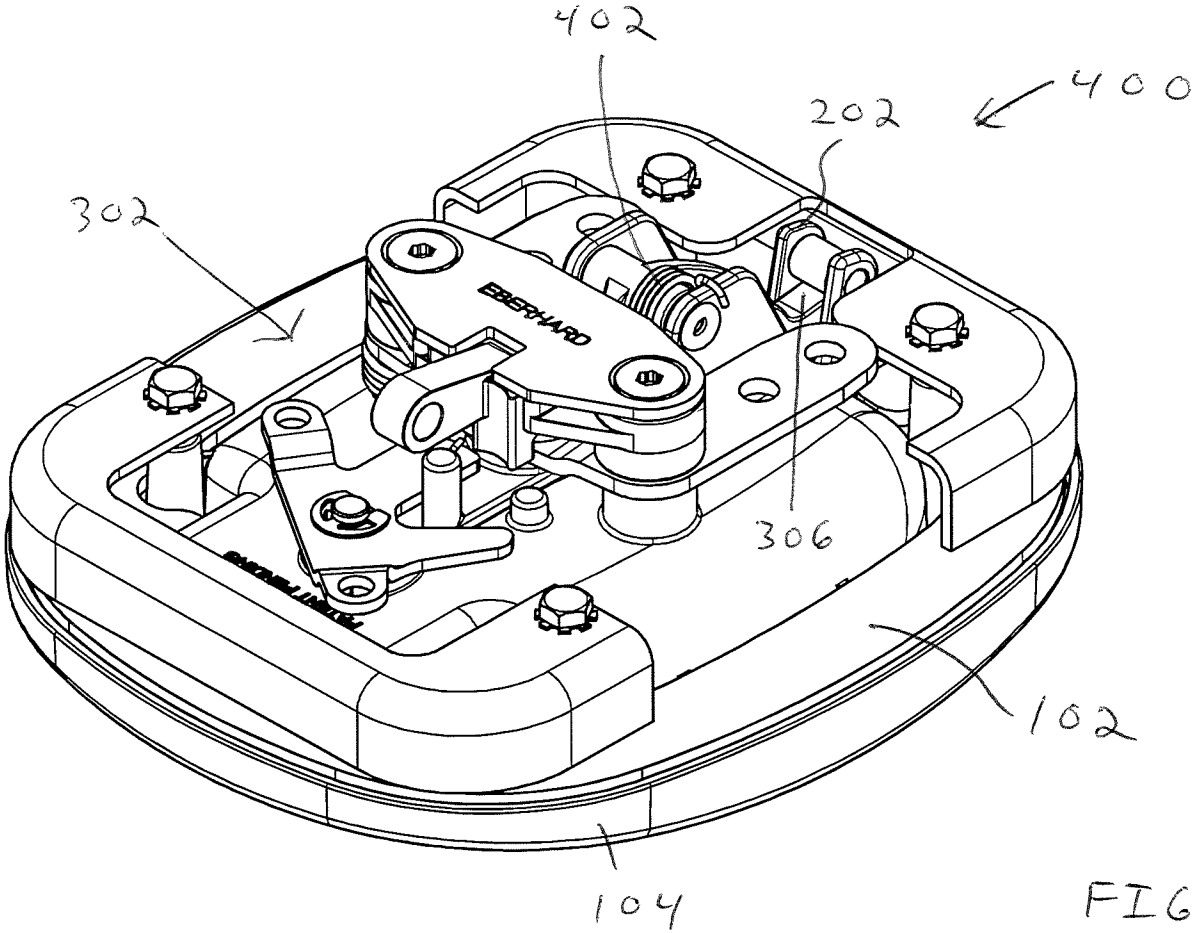
FIG. 4 is a rear isometric view of an example handle assembly when a handle is in an extended position.

In this described embodiment, the handle assembly may further include a lock slide 320 in movable connection with the rear side of the housing. When the lock slide 320 is in an operative position, the trigger is operative to move the lock slide when the trigger pivots to the second pivot position. FIG. 4 illustrates a rear view 400 of the handle assembly 102 showing the second/rear side 302 of the housing 104 while the handle is in the extended position and the trigger 306 has pivoted to the second pivot position. As shown in FIG. 4, the handle assembly 102 may also include a spring 402 that is operative to bias the trigger member 306 to pivot from the second pivot position (shown in FIG. 4) back to the first pivot position (shown in FIG. 3).

Referring back to FIG. 3, in this described example embodiment, the handle assemble 102 further includes at least one lever arm, which in this example includes two lever arms 312 and 314. Such lever arms are operative to pivot with respect to shafts 316, 318 connected to the rear side 302 housing 104 responsive to movement of the lock slide 320. Such shafts for example may extend through apertures in the lever arms. In this example, the shafts correspond to bolts that are in threaded connection with the housing. However, in alternative embodiments, that shafts may be connected via other fastening mechanisms (e.g., via welds).

This described example of the handle assembly may include an inside release mechanism 322. As will be explained in more detail below, in an operative orientation of the lock slide 320, the operation of either the inside release mechanism 322 and/or pivoting of the handle to the extended position, is operative to cause the lock slide 320 to move in a manner which causes the lever arms 312, 314 to pivot from the first pivot positions (shown in FIG. 3) to the second pivot positions (shown in FIG. 4).

These described lever arms 312, 314 may include one or more apertures 324 therethrough, which may be used to connect a linkage (e.g., such as a rod). Such a linkage may be connected to a latch mechanism (e.g., such as a rotary latch mechanism).

For example, the described handle assembly may be mounted to a door/hatch so as to provide the door with a user operated handle capable of unlatching the door/hatch. Pulling of the handle is operative to cause the lever arms to pivot, which in turn causes the connected linkages to operate a latch mechanism (also mounted to the door/hatch and/or the described handle assembly) to unlatch the door/hatch from a door/hatch frame of a vehicle or other structure. In this example, such a linkage may be mounted to an aperture 324 of one of the lever arms via a rod adapter that is operative to receive a rod or other linkages therein and fasten the rod to the aperture 324. Examples of linkages and latch mechanisms that may be connected to the described handle assembly are shown in U.S. Pat. No. 4,896,906.

Figure 5:
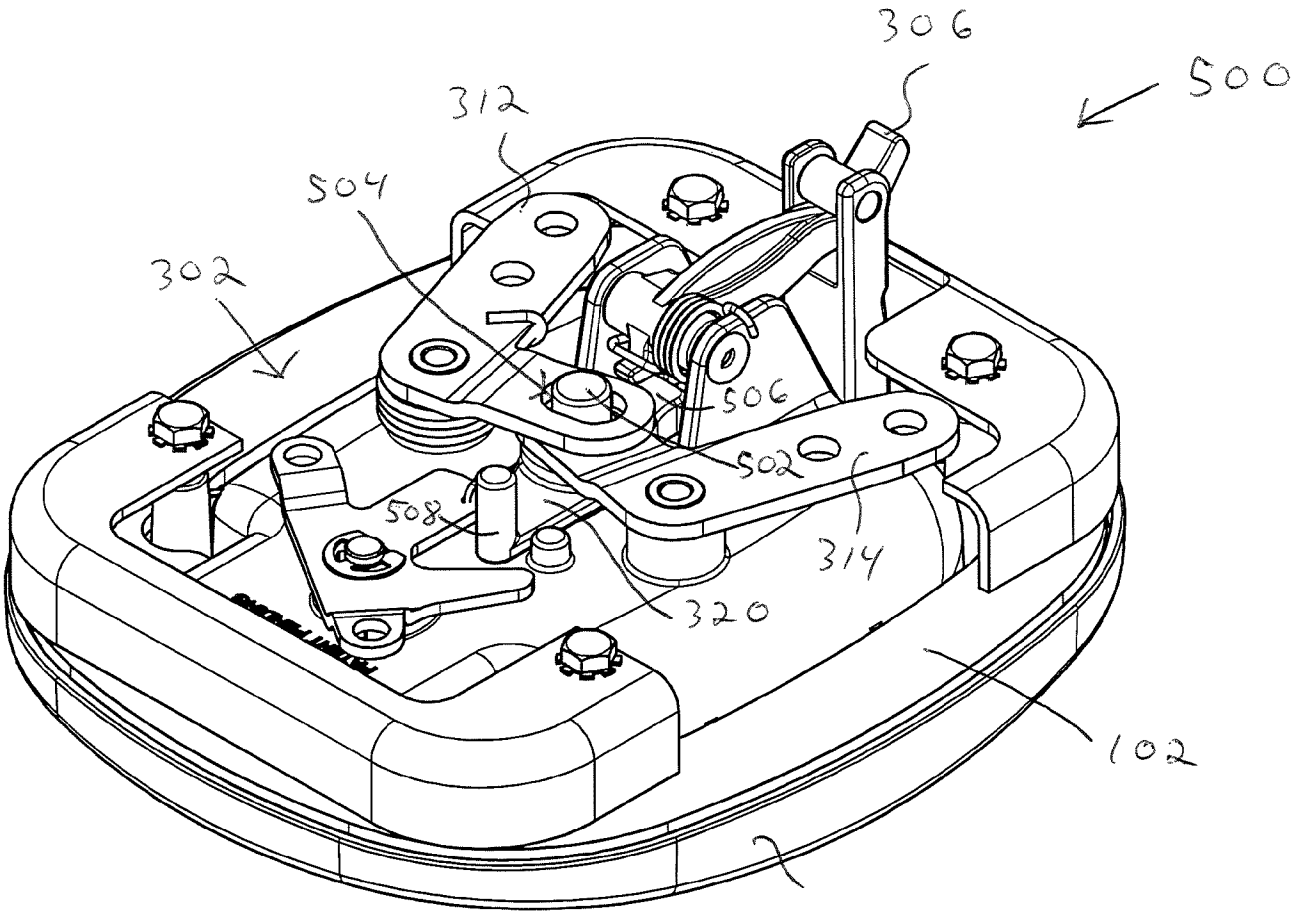
FIG. 5 is a rear isometric view of an example handle assembly when a handle is in a retracted position.

To aid in the understanding of the operation of the lock slide, FIG. 5 illustrates a rear view 500 of the handle assembly 102 without the release mechanism 322 (shown in FIGS. 3 and 4) while the handle is in the retracted position and the trigger 306 is in the first pivot position. As shown in FIG. 5, the lock slide 320 may include a shaft 502 positioned between opposed first and second ends 506, 508 of the lock slide 320. Such a shaft 502 is orientated to extend away from the rear side 302 of the housing 104. Each of the lever arms 312, 314 may include respective ends including apertures 504, through which the shaft 502 of the lock slide 320 extends.

Figure 6:
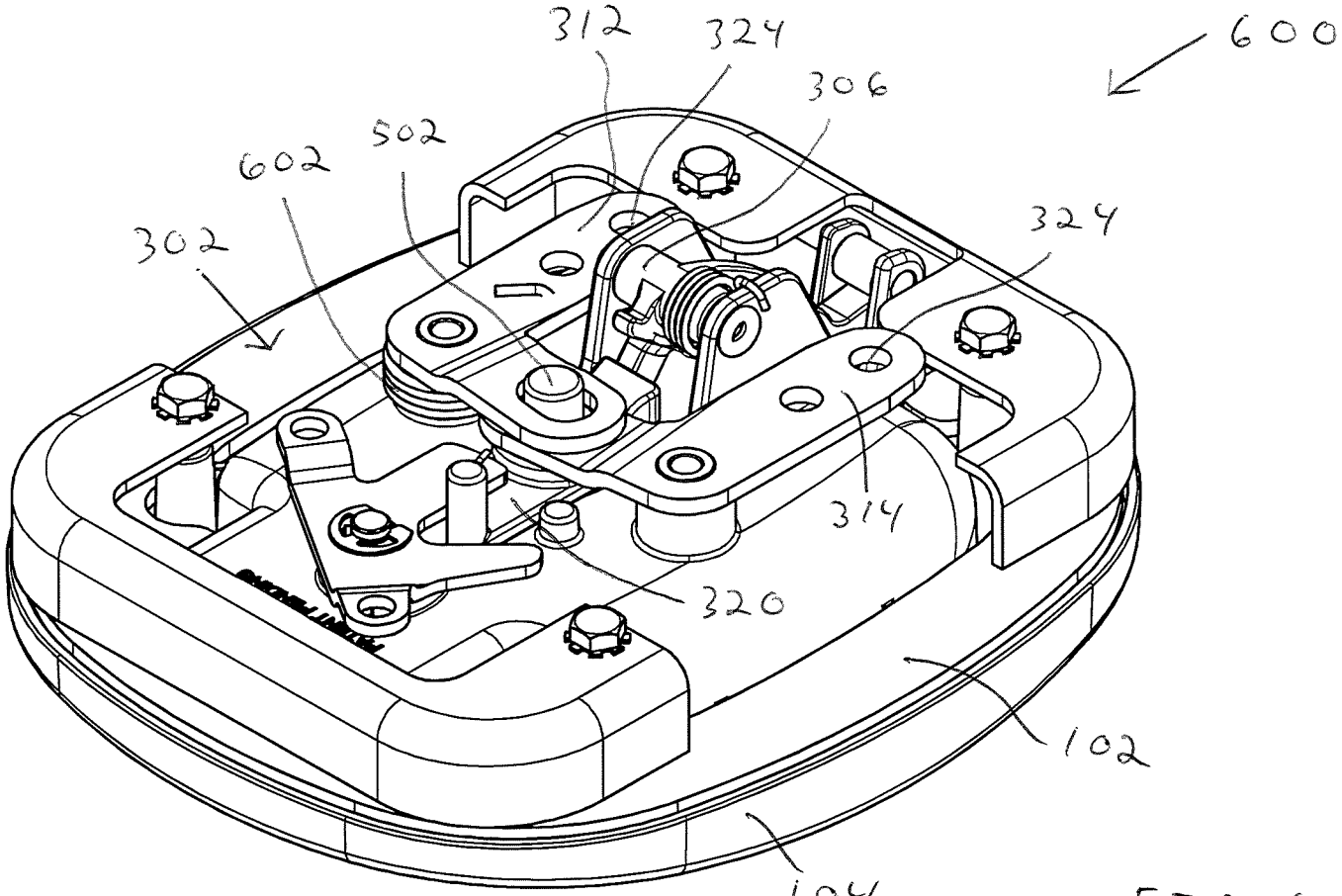
FIG. 6 is a rear isometric view of an example handle assembly when a handle is in an extended position.

In an example embodiment, the lock slide 320 is operative to slide longitudinally from a retracted position to an extended position (i.e., slide back and forth along a line that extends through the first end 506 and the second end 508). FIG. 5 shows the lock slide 320 in the retracted position. FIG. 6 shows an example view 600 in which the lock slide 320 has slid to the extended position. When the lock slide moves from the retracted position (shown in FIG. 5) to the extended position (shown in FIG. 6), the shaft 502 of the lock slide is operative to urge the lever arms 312, 314 to pivot such that the portions of the lever arms that include the apertures 324 for connecting linkages, move inwardly (i.e., closer to the trigger 306 as shown in FIG. 6).

As shown in FIG. 6, the handle assembly may include at least one spring 602 that is mounted so as to urge the lever arms 312, 314 to pivot back to the first pivot positions of the lever arms (shown in FIG. 5). When forces acting on the lock slide (which caused the lock slide to move to the second position shown in FIG. 6) have been released, tension from the spring 602 is operative to cause the lever arms 312, 314 to pivot to the first pivot positions, which in turn urges the lock slide to slide from the extended position (shown in FIG. 6) to the retracted position (shown in FIG. 5).

In an example embodiment, the lock slide 320 is operative to pivot between a first pivot position and a second pivot position generally with respect to the location of the shaft 502. FIGS. 3-6 all show the lock slide 320 in the first pivot position. In the first pivot position, the lock slide is operative to be urged to slide from the retracted position to the extended position responsive to either the trigger 306 or the inside release mechanism 322 (shown in FIGS. 3 and 4).

Figure 7:
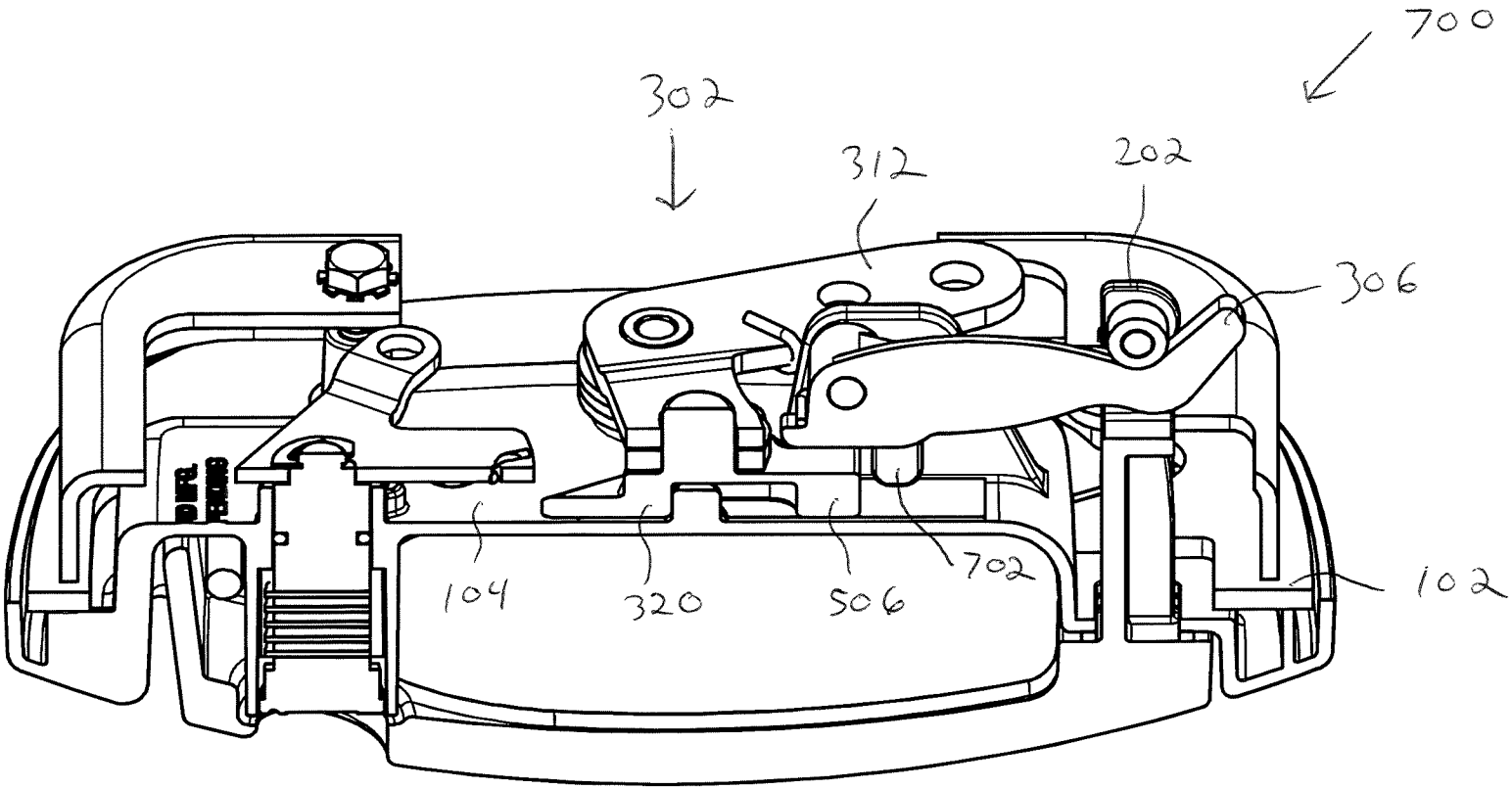
FIG. 7 is a cross-sectional view of an example handle assembly when a handle is in a retracted position.

FIG. 7 illustrates a cross-sectional view 700 of the handle assembly 102 showing the second/rear side 302 of the housing while the handle 106 is in the retracted position and the lock slide 320 is in the first pivot position. In this example, the trigger 306 may include a projection 702 that is located adjacent the first end 506 of the lock slide when the lock slide is in the first pivot position. When the trigger pivots from the first pivot position shown in FIG. 7 to a second pivot position in response to the pivoting of the handle, the projection is operative to urge the second end 508 of the lock slide so that the lock slide moves from the retracted position shown in FIG. 7 to the extended position.

Figure 8:
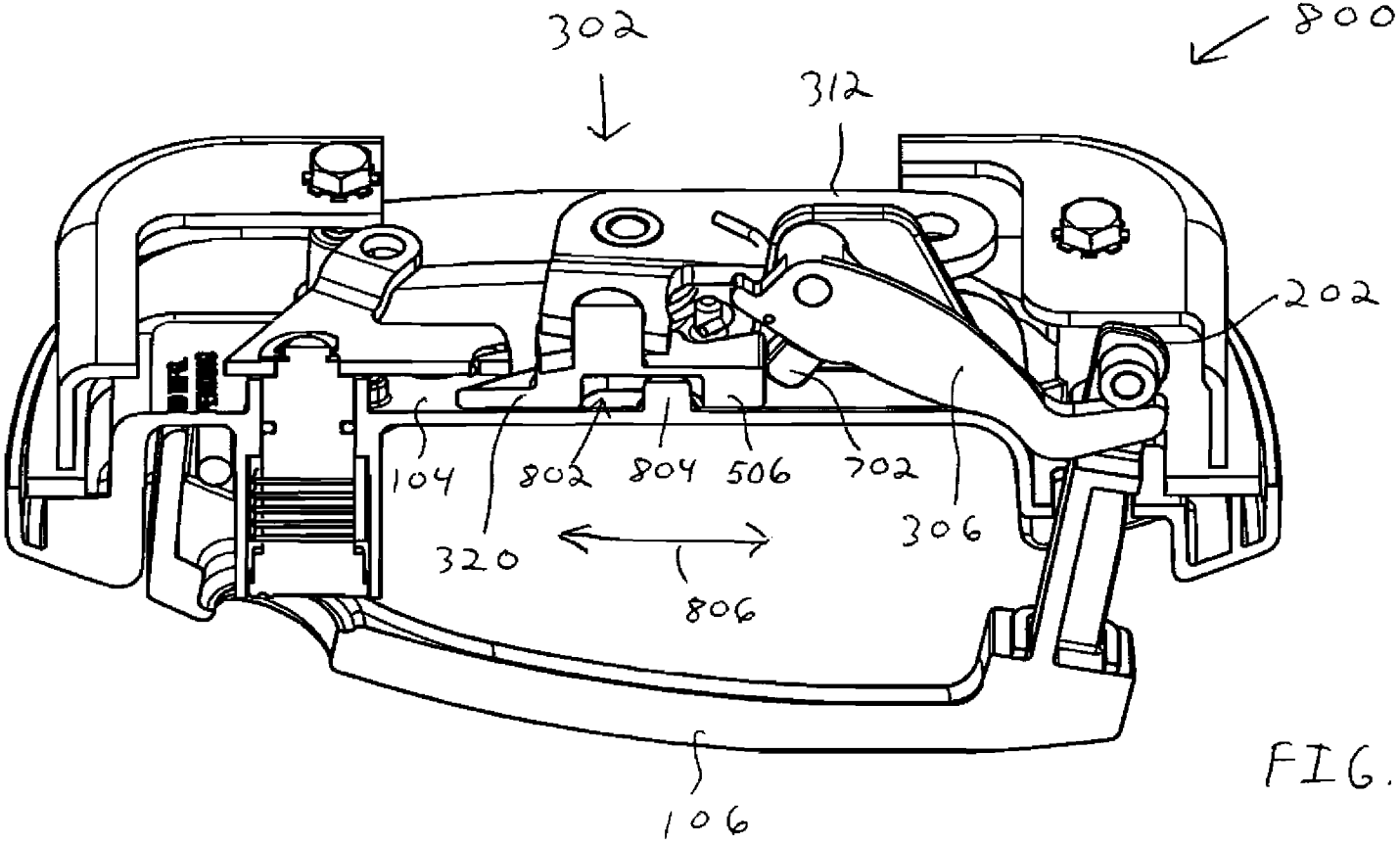
FIG. 8 is a cross-sectional view of an example handle assembly when a handle is in an extended position.

FIG. 8 illustrates a cross-sectional view 800 of the handle assembly 102 showing the second/rear side 302 of the housing after the handle 106 has been moved to the extended position. As shown in FIG. 8, the pivoting of the trigger 306 to the second pivot position has caused the projection 702 to move in a longitudinal direction 806 of the lock slide 320, to cause the lock slide to move longitudinally to the second position (shown in FIG. 8). Also as shown in FIG. 8, the lock slide 320 may include a lower slot 802 in which a projection 804 from the housing may project. Such a projection 804 of the housing may limit longitudinal movement of the lock slide 320 relative to the housing 104 while still permitting the lock slide to pivot around the projection 804.

In example embodiments of the housing assembly, rather than using the handle to operate the lever arms 312, 314, the inside release mechanism (shown in FIGS. 3 and 4) may be used instead. As shown in FIG. 3, the inside release mechanism 322 may include an inside release member 326 that is operative to slide longitudinally between a retracted position (shown in FIG. 3), and an extended position, generally in the same directions 806 (shown in FIG. 8) that the lock slide 320 is operative to longitudinally slide.

Figure 9:
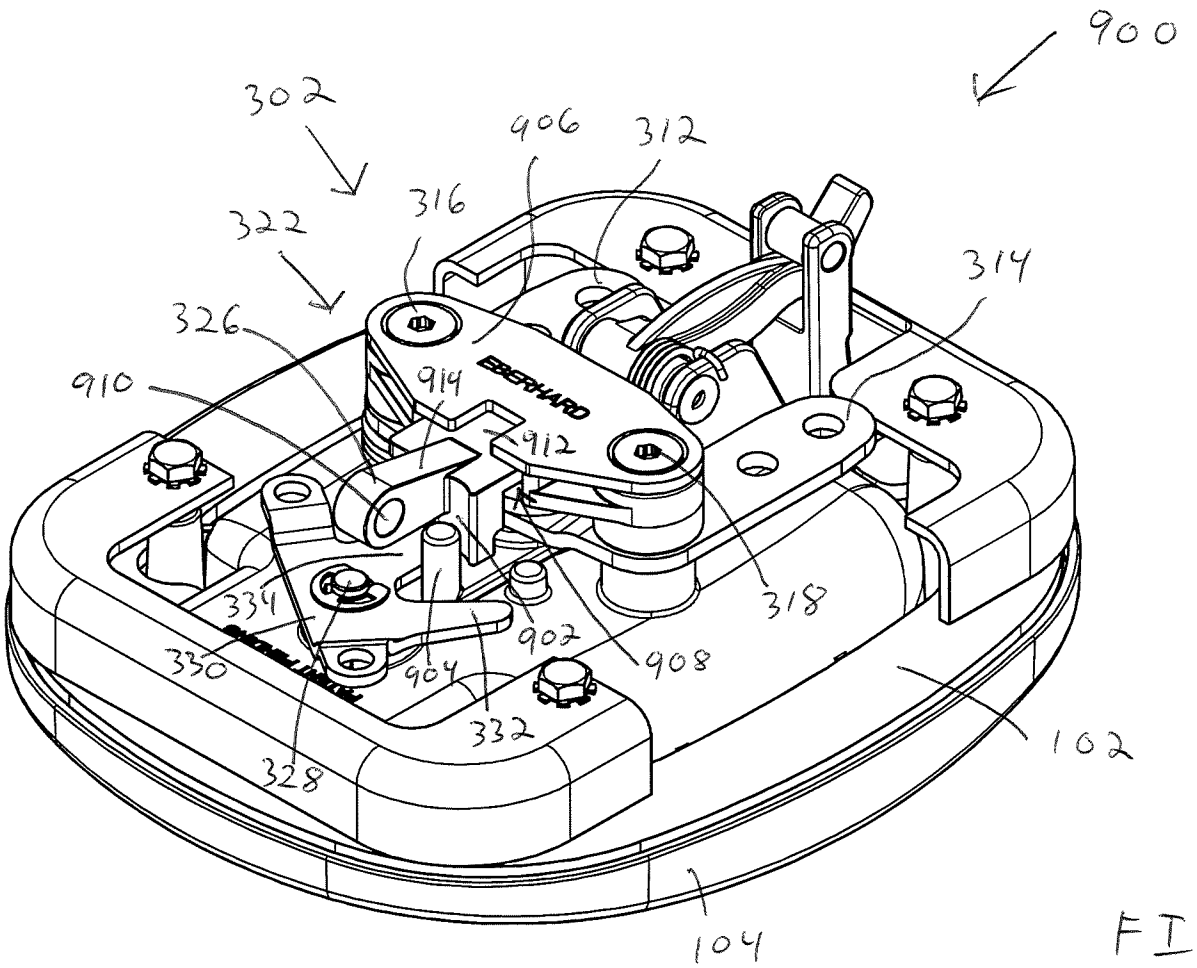
FIG. 9 is a rear isometric view of an example handle assembly when an inside release member is in an extended position.

FIG. 9 illustrates a rear view 900 of the handle assembly 102 showing the second/rear side 302 of the housing 104 while the handle is in the retracted position and the trigger 306 remains in the first pivot position. However, unlike FIG. 3, the inside release member 326 is shown after having moved longitudinally to the extended position of the inside release member. In this example embodiment, the inside release member 326 includes an engagement portion 902. Also the second end of the lock slide includes a projection 904 that extends generally outwardly from the rear side of the housing. When the inside release member 326 moves from the retracted position (shown in FIG. 3) to the extended position (shown in FIG. 9) of the inside release member, the engagement portion 902 is operative to contact the second end of the lock side via contact with the projection 904 and urge the lock slide to slide from the retracted position (shown in FIG. 3) to the extended position of the lock slide (shown in FIG. 9). As a result, this operation of the inside release mechanism 322 is operative to cause the lever arms 312, 314 to move from the first pivot positions (shown in FIG. 3) to the second pivot positions (shown in FIG. 9).

Also, as shown in FIG. 9, the engagement portion 902 may include a concave face that is operative to engage with the cylindrically shaped side of the projection 904. However, it should be appreciated that in alternative embodiments, the engagement portion and the projection may have other shapes and configurations (e.g., such as generally flat surfaces that contact each other).

In this described example, the inside release mechanism may include a mount member 906 that is operative to mount the inside release member 326 to the housing 104. Such a mount member may include a cavity 908 therein, in which an end 912 of the inside release member is operative to slide. In this example, the mount member is mounted to the housing via the same shafts/bolts 316, 318 that serve as shafts for the lever arms 312, 314. However, it should be appreciated that the mount member 906 may be mounted via different and/or other types of fasteners to the housing 104 of the handle assembly 102.

In an example embodiment, the inside release member 326 may include an aperture 910 through a projection portion 914. Such an aperture 910 may be used to connect the inside release member 326 (via rods or other linkages) to another handle. Such another handle may be located on an inside face of a door, while the described handle assembly is mounted on the same door but with the handle of the described handle assembly located on an outside face of a door.

Figure 10:
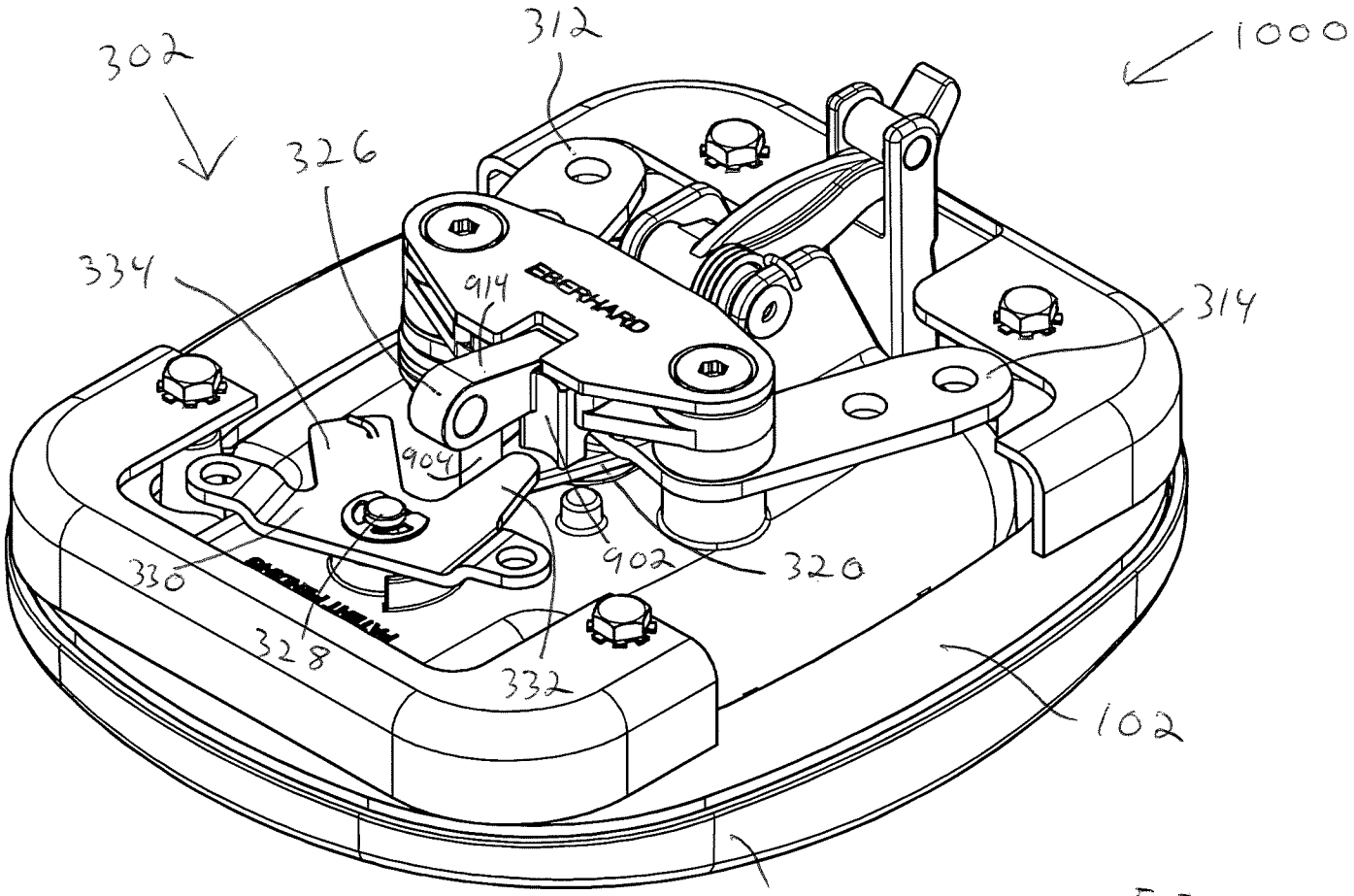
FIG. 10 is a rear isometric view of an example handle assembly when a lock slide is in a pivot position that places the handle assembly in a locked state.

In FIG. 9 the lock slide is orientated in the first pivot position. As a result, the projection 904 of the lock slide is aligned with the engagement portion 902 of the inside release member 326. FIG. 10 illustrates a rear view 1000 of the handle assembly showing the second/rear side 302 of the housing while the handle is in the retracted position and the inside release member 326 is in the retracted position. However, unlike FIG. 3, the lock slide 320 is rotated to the second pivot position. As shown in FIG. 10, the projection 904 of the lock slide 320 is no longer aligned with the engagement portion 902 of the inside release member. Also, as shown in FIG. 10, the projection portion 914 of the inside release member 326 may extend further outwardly than the engagement portion 902. However, unlike the engagement portion, the projection portion 914 may not be orientated to contact the projection 904 of the lock slide 320. Rather the projection portion 914 of the inside release member may extend above the projection 904 of the lock slide. Thus when the projection 904 of the lock slide moves from the first pivot position to the second pivot position of the lock slide, the projection 904 of the lock slide is operative to pass underneath the projection portion 914 of the inside release member.

Figure 11:
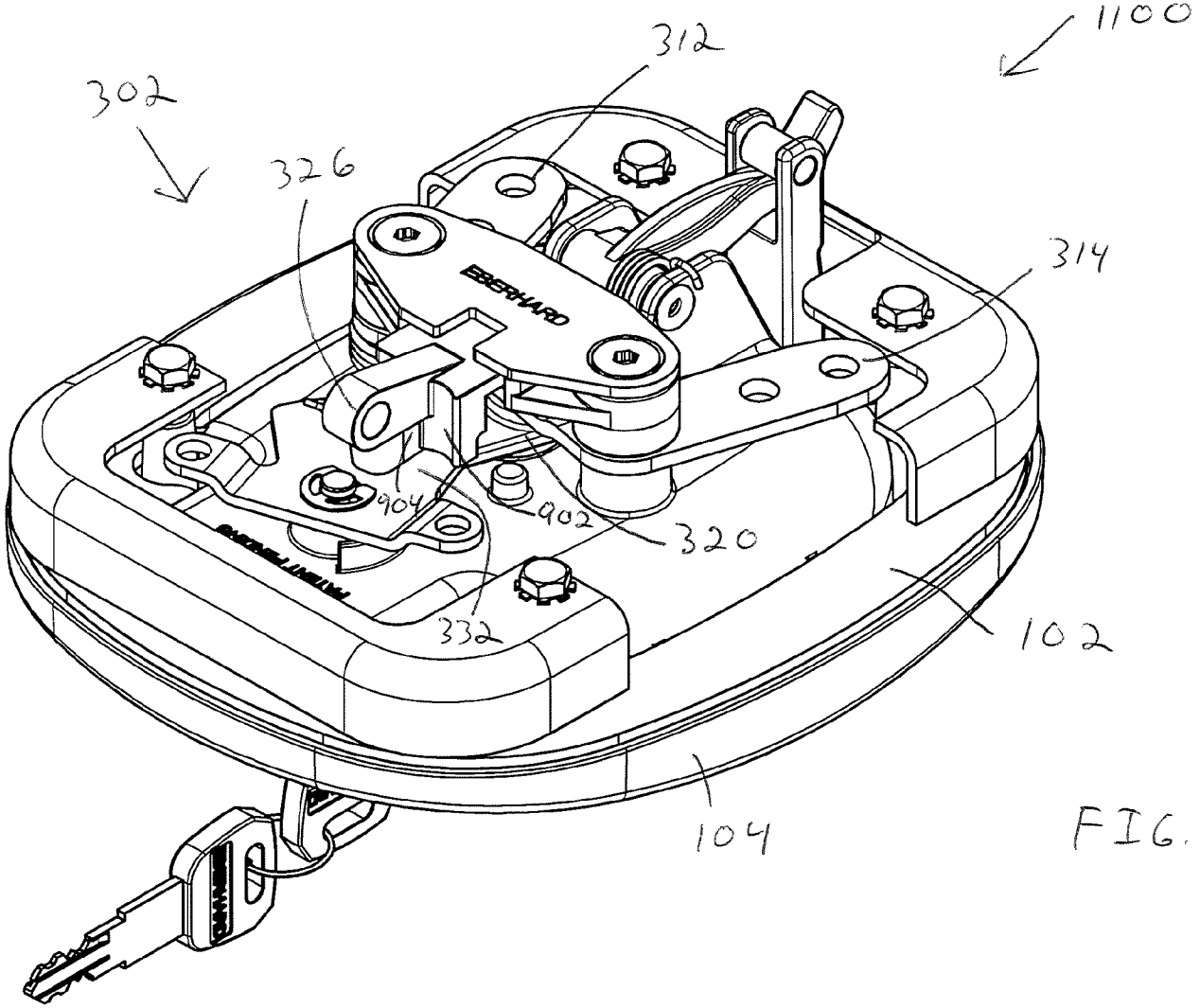
FIG. 11 is a rear isometric view of an example handle assembly when a lock slide is in a pivot position that places the handle assembly in a locked state and an inside release member is in an extended position.

FIG. 11 illustrates a rear view 1100 of the handle assembly 102 showing the second/rear side 302 of the housing 104 with the lock slide 320 in the second pivot position, and with the inside release member 326 moved to the extended position. Because the projection 904 of the lock slide is no longer aligned with the engagement portion 902, movement of the inside release member 326 from the retracted position (shown in FIG. 10) to the extended position (shown in FIG. 11) does not cause the lock slide 320 to slide from the retracted position of the lock slide (shown in FIG. 10) to the extended position of the lock slide (such as shown in FIG. 9). Thus in FIG. 11, the lock slide 320 is still shown in the retracted position, with the engagement portion 902 having traveling beside the projection 904.

It should also be noted that when the lock slide is in the second pivot potion, the first end 506 of the lock slide may no longer be adjacent the projection 702 of the trigger 306 (as was shown in FIG. 7). As a result, movement of the handle from the retraced position (shown in FIG. 1) to the extended position (shown in FIG. 2) will also not cause the lock slide to slide from the retracted position of the lock slide to the extended position of the lock slide. Thus in this described embodiment, when the lock slide is pivoted to the second pivot position (shown in FIGS. 10 and 11), neither the handle nor the inside release member is operative to cause the lever arms 312, 314 to pivot and cause an operatively connected latch mechanism to unlatch a door/hatch.

For example, as shown in FIG. 11, the lever arms remain in the first pivot positions and did not move to the second pivot positions of the lever arms (such as shown in FIG. 9). Thus, when the lock slide is pivoted to the second pivot position (shown in FIGS. 10 and 11) the example handle assembly 102 is in a locked configuration. However, when the lock slide is pivoted to the first pivot position (as shown in FIGS. 7-9), the handle assembly 102 is in an unlocked state.

To provide a user with control over the pivoting position of the lock slide (and thus the locked and unlocked states of the handle assembly), an example embodiment of the handle assembly may include a lock mechanism. FIG. 1 shows an example of a lock mechanism 110 mounted to the housing 104 that is in the form of a cylinder lock. In this example, the handle 106 includes an aperture 112 through the end of the handle that is in pivoting connection with the housing. Such an aperture may expose an end of the lock cylinder for enabling the insertion of a key 114.

Figure 12:
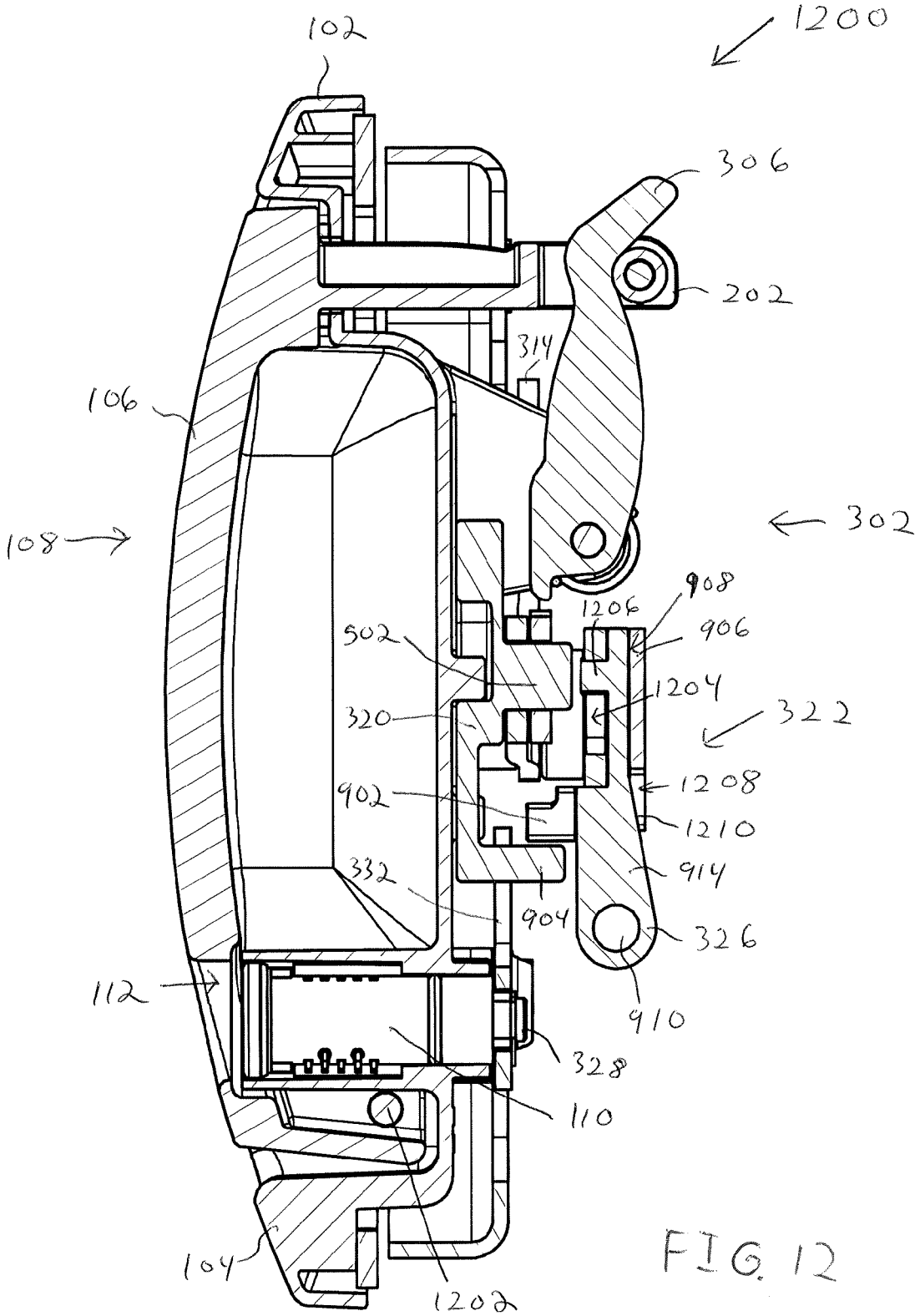
FIG. 12 is a cross-sectional view of an example handle assembly when a lock slide is in a pivot position that places the handle assembly in a locked state.

FIG. 12 illustrates a cross-sectional view 1200 of the handle assembly 102, which shows an example configuration of the cylinder lock 110. As shown in FIG. 12, the cylinder extends from the front side 108 of the housing 104 to the rear side 302 of the housing above a shaft 1202 through the lower portion of handle 106 (at which the handle pivots). However, it should be appreciated that in alternative embodiments, the handle and lock mechanism may have different configurations. For example the lock mechanism 110 may be position to extend through an opening in the housing that is below, above and/or beside the handle.

In an example embodiment, a compatible key when inserted in the cylinder lock, is operative to be rotated by a user to cause a rotational portion of the cylinder lock to rotate that is located on the rear side of the housing. Referring back to FIG. 3, such a rotational portion of the cylinder lock may correspond to a shaft 328 to which is mounted a lock arm 330. Such a lock arm 330 may be operative to rotate back and forth responsive to a key 114 turning clockwise and counter clockwise in the lock mechanism.

The lock arm 330 may include first and second projections 332, 334. As shown in FIG. 10, such projections may extent on opposed sides of the projection 904 of the lock slide. Thus clockwise and counter-clockwise rotation of the lock arm (responsive to a key turning in the cylinder lock) is operative to cause the projections 332, 334 to alternately contact the projection 904 of the lock slide 320 so as to urge the lock slide to move between the second rotational position (shown in FIG. 10) and the first rotational position (such as shown in FIG. 3). As shown in FIG. 11, the engagement portion 902 of the inside release member 326 may be located on the inside release member such that it does not interfere with the lock arm. For example, the engagement portion 902 may be configured such that the engagement portion passes over an end of first projection 332 when the inside release member 326 moves to the extended position.

Referring back to FIG. 3, an example embodiment of the lock arm 330 may include one or more apertures 336, to which a rod or other linkage may be connected. Such a linkage may connect the lock arm 330 to a manually operated button or other type of actuator that is operative to cause the lock arm to rotate and cause the lock slide to change between the first and second pivot positions of the lock slide. Thus in addition to using a key in the lock mechanism, such a linkage connected to the lock arm 330 may provide a further manner in which to place the handle assembly 102 in locked or unlocked states. In addition, it should be noted that in alternative embodiments, the lock mechanism 110 may not be mounted to the housing 104 of the handle assembly. For example a lock mechanism may be mounted to a different location on a door/hatch and may be connected to the lock arm 330 via a linkage.

FIG. 12 also shows a cross-section of the mount member 906 of the inside release mechanism 322. Such a mount member may include a lower opening or channel 1204 in which a projection 1206 of the inside release member may extend. Such a projection 1206 in the channel 1204 may limit movement of the inside release member 326 between the retracted and extended positions described previously. Also, as shown in FIG. 12, the top of the mount member 906 may include an opening 1208 that allows an upper contour 1210 of the projection member 914 to slope upwardly from positions within the mount member 906 (when in the retracted position) so that the projection member 914 increases in cross-sectional height to accommodate the aperture 910.

In addition, in the embodiments described herein, the lock arm 330 has been shown mounted directly to the rotational portion 328 of the lock mechanism (see FIG. 3). However, it should be appreciated that in alternative embodiments, the lock arm may be mounted in pivoting connection with a portion of the housing, and a linkage connected to the rotational portion of the lock mechanism may be operative to engage the lock arm and cause the lock arm to rotate.

Although, the previously described examples of a handle assembly have been described as including an inside release mechanism, it should be appreciated that alternative embodiments may not include an inside release mechanism. For example, such an alternative embodiment may have a form similar to that shown in FIGS. 5 and 6. Although, such an alternative embodiment may not include an inside release mechanism, alternative handle assemblies may include a shaft which engages a trigger (such as the shaft 202 shown in FIG. 3) which has a roller 338 to enable the trigger 306 to slide more smoothly with respect to the shaft 202.

It is noted that several examples have been provided for purposes of explanation. These examples are not to be construed as limiting the hereto-appended claims. Additionally, it may be recognized that the examples provided herein may be permutated while still falling under the scope of the claims. Further, it should be appreciated that the examples of an inside release mechanism shown herein may be adapted for use with other configurations of handle assemblies that include a lock slide that changes the handle assembles between locked and unlocked states.

What is claimed is:

1. A handle assembly comprising:

a housing, wherein the housing includes a first side and a second side and an aperture therethrough, a trigger in operative pivotable connection with the housing on the second side of the housing, wherein the trigger is operative to pivot between a first pivot position and a second pivot position, a handle in operative pivotable connection with the housing on the first side of the housing, wherein the handle is in operative engagement with a shaft, wherein the shaft extends through the aperture into operative engagement with the trigger, wherein the handle is operative to pivot between a retracted position and an extended position with respect to the first side of the housing, at least one lever arm in operative pivotable connection with the housing on the second side of the housing, wherein the at least one lever arm is operative to pivot between a first pivot position and a second pivot position, an inside release member in operative movable connection with the housing on the second side of the housing, wherein the inside release member is operative to slide longitudinally between a retracted position and an extended position, a lock slide in operative movable connection with the housing on the second side of the housing, wherein the lock slide includes a first end and a second end, wherein the lock slide is operative to slide longitudinally between a retracted position and a extended position, wherein the lock slide is configured to pivot between a first pivot position and a second pivot position, wherein the shaft is configured to operatively engage the trigger and urge the trigger to pivot from the first pivot position to the second pivot position of the trigger as the handle pivots from the retracted position to the extended position, wherein when the lock slide is in the first pivot position:

the trigger is configured to operatively engage the first end of the lock slide and urge the lock slide to slide from the retracted position to the extended position of the lock slide as the trigger pivots from the first pivot position to the second pivot position; and the inside release member is configured to operatively engage the second end of the lock slide and urge the lock slide to slide from the retracted position to the extended position of the lock slide as the inside release member slides from the retracted position to the extended position of the inside release, wherein the lock slide is configured to operatively engage the at least one lever arm and urge the at least one lever arm to pivot from the first pivot position to the second pivot position as the lock slide slides from the retracted position to the extended position, wherein when the lock slide is in the second pivot position, the trigger and the inside release member are configured not to operatively engagingly urge the respective first and second ends of the lock slide so as to cause the lock slide to slide from the retracted position to the extended position.

2. The handle assembly according to claim 1, wherein the inside release member includes an engagement portion, wherein the second end of the lock slide includes a projection, wherein when the lock slide is in the first pivot position and the inside release member slides from the retracted position to the extended position, the engagement portion of the inside release member is operative to contact the projection of the lock slide.

3. The handle assembly according to claim 2, wherein the engagement portion includes a concave surface, wherein the projection of the lock slide includes a cylindrical surface.

4. The handle assembly according to claim 2, wherein when the lock slide is in the second pivot position of the lock slide, the engagement portion is not operative to contact the projection when the inside release member moves from the retracted position to the extended position of the inside release member.

5. The handle assembly according to claim 4, wherein the inside release member includes a projection portion that extends outwardly of the engagement portion, wherein when the lock slide pivots from the first pivot position to the second pivot position, the projection of the lock slide is operative to pass under the projection portion of the inside release member.

6. The handle assembly according to claim 5, wherein the projection portion of the inside release member includes an aperture to which a linkage is operative to be fastened.

7. The handle assembly according to claim 5, further comprising a lock mechanism in operative connection with the housing, wherein the lock mechanism is operative to cause the lock slide to pivot between the first and second pivot positions of the lock slide.

8. The handle assembly according to claim 7, wherein the lock mechanism includes a rotational portion that is operative to rotate responsive to an inserted key being rotated, further comprising a lock arm in operative connection with the rotational portion of the lock mechanism, wherein the lock arm is operative to contact the projection of the lock slide and cause the lock slide to pivot responsive to rotation of the rotational portion.

9. The handle assembly according to claim 8, wherein the lock arm includes two projections that extends on opposed sides of the projection of the lock slide, wherein when the rotational portion of the lock mechanism rotates and causes the lock slide to pivot from the first pivot position to the second pivot position, the engagement portion is operative to extend over at least one of the projections of the lock arm as the inside release moves from the retracted position to the extended position.

10. The handle assembly according to claim 1, further comprising a roller in operative rotational connection with an end of the shaft, wherein when the handle moves from the retracted position to the extended position, the roller is operative to roll along a surface of the trigger and urge the trigger to pivot from the first pivot position to the second pivot position.

11. The handle assembly according to claim 1, further comprising an inside release mechanism, wherein the inside release mechanism includes the inside release member and a mount member, wherein the mount member, wherein the mount member includes a cavity therein, wherein a portion of the inside release member is operative to slide inside the cavity.

12. The handle assembly according to claim 11, further comprising two bolts, wherein the at least one lever arm includes two lever arms, wherein the lever arms are operative to pivot with respect the respective bolts that extend through apertures in the respective lever arms into operative connection with the housing, wherein the mount member is fastened to the housing with the two bolts through the two lever arms.

13. A handle assembly comprising:

a housing, and a trigger, an inside release member, a lock slide, at least one lever arm, and a handle in operative connection with the housing, wherein the lock slide is in operative movable connection with the housing, wherein when the lock slide is in a first pivot position with respect to the housing, the lock slide is operative to slide in a longitudinal direction, wherein the longitudinal direction extends along a direction between first and second longitudinal ends of the lock slide, and is operative to cause the at least one lever arm to move responsive to each of either:

pivoting movement of the handle, wherein such pivoting movement is operative to cause the trigger to pivot and operatively engagingly urge the first longitudinal end of the lock slide to move in the longitudinal direction; or longitudinal sliding movement of the inside release member, wherein such sliding movement is operative to cause the inside release member to operatively engagingly urge the second longitudinal end of the lock slide to move in the longitudinal direction, wherein when the lock slide is in a second pivot position with respect to the housing, the trigger and the inside release member are configured to not operatively engagingly urge the respective first and second longitudinal ends of the lock slide to move in the longitudinal direction.

14. The handle assembly according to claim 13, wherein the inside release member includes an engagement portion, wherein the second end of the lock slide includes a projection, wherein when the lock slide is in the first pivot position, the engagement portion is operative to contact the projection of the lock slide to urge the lock slide to move in the longitudinal direction.

15. The handle assembly according to claim 14, wherein the engagement portion includes a concave surface, wherein the projection of the lock slide includes a cylindrical surface.

16. The handle assembly according to claim 14, wherein when the lock slide is in the second pivot position of the lock slide, the engagement portion is not operative to contact the projection.

17. A handle assembly comprising:

a housing, and a trigger, an inside release member, a lock slide, at least one lever arm, and a handle in operative connection with the housing, wherein the lock slide is relatively movable in operative connection with the housing along a linear direction and is selectively rotationally movable between a first pivot position and a second pivot position, wherein when the lock slide is in the first pivot position, the lock slide is operative to slide along the direction and cause the at least one lever arm to move responsive to each of either:

movement of the handle relative to the housing, wherein such movement is operative to cause the trigger to operatively engagingly urge a first end of the lock slide to move along the direction relative to the housing; or movement of the inside release member relative to the housing, wherein such movement is operative to cause the inside release member to operatively engagingly urge a second end of the lock slide opposed of the first end, to move along the direction relative to the housing, wherein when the lock slide is in the second pivot position, the trigger and the inside release member are configured to not operatively engagingly urge the respective first and second ends of the lock slide to move along the direction responsive to either movement of the handle or movement of the inside release member, wherein the inside release member includes a projection portion, and wherein the lock slide includes an engagement portion adjacent second end, wherein when the lock slide is in the first pivot position movement of the inside release member causes operative engagement of the projection portion and the engagement portion whereby the lock slide moves along the direction, and wherein when the lock slide is in the second pivot position, the projection portion of the inside release member and the engagement portion do not operatively engage to cause movement of the lock slide, when the inside release member is moved.

18. The handle assembly according to claim 13, wherein the handle comprises a shaft, wherein the handle assembly further comprises a roller in operative rotational connection with an end of the shaft, wherein when the handle moves from a retracted position to an extended position with respect to the housing, the roller is operative to roll along a surface of the trigger and urge the trigger to pivot.

19. The handle assembly according to claim 13, further comprising an inside release mechanism, wherein the inside release mechanism includes the inside release member and a mount member, wherein the mount member includes a cavity therein, wherein a portion of the inside release member is operative to slide inside the cavity.

20. The handle assembly according to claim 19, further comprising two bolts, wherein the at least one lever arm includes two lever arms, wherein the lever arms are operative to pivot with respect the respective bolts that extend through apertures in the respective lever arms into operative connection with the housing, wherein the mount member is fastened to the housing with the two bolts through the two lever arms.

21. The handle assembly according to claim 13, and further comprising:

a lock, wherein the lock is in operative connection with the housing, wherein the lock is changeable between locked and unlocked conditions, wherein in the unlocked condition the lock is operative to cause the lock slide be positioned in the first pivot position, and wherein in the locked condition, the lock is operative to cause the lock slide to be positioned in the second pivot position.

22. The handle assembly according to claim 21, and further including an arm, wherein the arm is in operative connection with the lock, wherein the arm is enabled to move responsive to a proper key being in engagement with the lock, wherein the arm is configured to operatively engage the lock slide and cause the lock slide to move between the first and second pivot positions.

* * * * *